US007350688B2

(12) United States Patent
Sierra-Gomez et al.

(10) Patent No.: US 7,350,688 B2
(45) **Date of Patent: *Apr. 1, 2008**

(54) RESEALABLE FOOD CONTAINER

(75) Inventors: Gladys Odette Sierra-Gomez, Woodbridge, NJ (US); Eva Marie Peters, Cedar Grove, NJ (US); Alexis Julian Garcia-Lugo, Bloomingdale, NJ (US)

(73) Assignee: Kraft Foods Holdings, Inc., Northfield, IL (US)

( * ) Notice: Subject to any disclaimer, the term of this patent is extended or adjusted under 35 U.S.C. 154(b) by 436 days.

This patent is subject to a terminal disclaimer.

(21) Appl. No.: 11/029,626

(22) Filed: Jan. 6, 2005

(65) Prior Publication Data

US 2006/0144911 A1 Jul. 6, 2006

(51) Int. Cl.

| | |
|---|---|
| ***B65D 65/26*** | (2006.01) |
| ***B65D 75/28*** | (2006.01) |
| ***B65D 85/00*** | (2006.01) |
| ***B65D 25/10*** | (2006.01) |

(52) U.S. Cl. ..... 229/87.08; 206/459.1; 229/87.05; 383/203; 383/205; 426/119

(58) Field of Classification Search ..... 383/203–206, 383/210–211, 66; 229/87.05, 87.08; 426/106, 426/112–115, 119, 122–124

See application file for complete search history.

(56) References Cited

U.S. PATENT DOCUMENTS

| | | | |
|---|---|---|---|
| 3,618,751 | A * | 11/1971 | Rich ..... 229/123.1 |
| 3,740,328 | A | 6/1973 | Graham |
| 4,156,493 | A | 5/1979 | Julius |
| 4,185,754 | A | 1/1980 | Julius |
| 4,197,949 | A | 4/1980 | Carlsson |
| 4,552,269 | A | 11/1985 | Chang |
| 4,840,270 | A | 6/1989 | Caputo et al. |
| 4,848,575 | A | 7/1989 | Nakamura et al. |
| 5,503,858 | A | 4/1996 | Reskow |
| 5,647,506 | A | 7/1997 | Julius |
| 5,688,394 | A | 11/1997 | McBride, Jr. et al. |
| 5,725,311 | A | 3/1998 | Ponsi et al. |
| D394,605 | S | 5/1998 | Skiba et al. |
| 5,791,465 | A | 8/1998 | Niki et al. |
| 5,938,013 | A | 8/1999 | Palumbo et al. |

(Continued)

FOREIGN PATENT DOCUMENTS

| | | |
|---|---|---|
| EP | 0 474 981 | 3/1992 |

(Continued)

*Primary Examiner*—Bryon P Gehman
(74) *Attorney, Agent, or Firm*—Stites & Harbison PLLC; Marvin Petry

(57) ABSTRACT

A container for a food product includes a wrapper which surrounds a frame. The container can be any polygonal shape which is defined by the shape of the frame. The wrapper forms a top of the container which has an access opening. A sealing cover is adhesively sealed to the top around the opening. The sealing cover is operable to expose the access opening and reclosable against the top to seal the access opening. The sealing cover, adhesive and top surface are optimized to provide sealing characteristics of sufficiently resealing frequency, relatively low noise level during unsealing and desirable peel forces to separate the seal between the sealing cover and the top.

56 Claims, 4 Drawing Sheets

U.S. PATENT DOCUMENTS

| | | | | |
|---|---|---|---|---|
| 5,945,145 | A | 8/1999 | Narsutis et al. | |
| 6,029,809 | A | 2/2000 | Skiba et al. | |
| 6,065,591 | A | 5/2000 | Dill et al. | |
| 6,113,271 | A | 9/2000 | Scott et al. | |
| 6,126,009 | A | 10/2000 | Shiffler et al. | |
| 6,164,441 | A | 12/2000 | Guy et al. | |
| D447,054 | S | 8/2001 | Hill | |
| 6,309,105 | B1 | 10/2001 | Palumbo | |
| 6,420,006 | B1 | 7/2002 | Scott | |
| 6,428,867 | B1 | 8/2002 | Scott et al. | |
| 6,517,243 | B2 | 2/2003 | Huffer et al. | |
| 6,746,743 | B2 | 6/2004 | Knoerzer et al. | |
| 6,767,604 | B2 | 7/2004 | Muir, Jr. et al. | |
| 6,918,532 | B2 | 7/2005 | Sierra-Gomez et al. | |
| 2003/0039412 | A1* | 2/2003 | Rodick | 383/211 |
| 2003/0210838 | A1 | 11/2003 | Steele | |
| 2004/0180118 | A1* | 9/2004 | Renger et al. | 426/106 |
| 2006/0018569 | A1 | 1/2006 | Bonenfant | |

FOREIGN PATENT DOCUMENTS

| | | |
|---|---|---|
| EP | 1 375 380 | 1/2004 |
| FR | 1327914 | 4/1963 |
| JP | 2000335542 | 12/2000 |

* cited by examiner

RESEALABLE FOOD CONTAINER

FIELD OF THE INVENTION

The present invention relates to a resealable container, and in particular, a new and improved resealable container having a reclosable sealing cover which can be pulled back and closed against a top portion of the container.

BACKGROUND OF THE INVENTION

Containers for food products such as cookies and other snacks typically include a frame surrounded by an outer wrapper. The frame acts as a tray to hold the food product and to protect the food product from damage. One normally gains access to the contents of the container by opening one end of the wrapper, withdrawing the tray from the inside thereof, and then removing the food product from the tray. However, these containers generally do not provide a convenient opening and reclosing arrangement. For example, reclosing of the wrapper, once opened, generally includes simply folding or rolling the end down and clipping the end to keep the wrapper closed.

Reclosable seals have been used for dispensing bags for wet tissues or disposable cleaning wipes. The label on these bags can be pulled back, thereby exposing an opening, allowing access to the wet tissues or wipes inside. Typically, these dispensing bags are completely flexible, formed exclusively of a plastic or other suitable flexible material which closely surrounds the pack of wet tissues or wipes. Examples of these dispensing bags include U.S. Pat. Nos. 4,840,270 and 6,026,953, U.S. Design Pat. No. D 447,054 and U.S. Patent Application Publication No. 2002/0182359. However, such known dispensing bags are not well suited for containing food products as these containers fail to provide adequate protection for storing food products.

One recent resealable food container is disclosed in U.S. Patent Publication No. 2004/0206637, herein incorporated by reference. The disclosed resealable container is adapted for use with food products and includes a frame which defines a polygonal shape and a wrapper which surrounds the frame and has a top opening. A sealing layer is adhesively sealed to the top.

The present invention concerns optimizing sealing characteristics between a sealing cover and the top of a container adjacent an opening of the container, which characteristics include sufficient resealing frequency, sufficiently low noise level during unsealing and desirable peel force to separate a seal between a sealing cover and the top of the container.

BRIEF SUMMARY OF THE INVENTION

The purpose of the present invention is to provide a new and improved container for food products such as cookies and the like in which the container provides adequate protection for the contents thereof, while concurrently facilitating opening of the container wrapper and resealing the seal to protect the contents thereof until the contents are fully consumed. Individual or a combination of container components provide for optimized or desired characteristics of sufficient resealing frequency, sufficiently low noise level during unsealing, and desirable peel force to separate the seal between the sealing cover and the top. For example container elements including the sealing cover, adhesive and top surface material are selected specifically in order to optimize the aforementioned characteristics.

This purpose is achieved by providing a suitable container composed of selected materials which comprise the sealing cover, adhesive and top surface of the container in order to provide the desired sealing/resealing characteristics.

In accordance with one embodiment, the present invention comprises a polygonal food container having a frame defining the polygonal shape of the container and containing a food product. A wrapper surrounds the frame and forms a top of the container. The top has an access opening sufficiently large to provide access to the food product. A sealing cover has an adhesive and forms a resealable seal to the top in a sealing area between the access opening and an adjacent edge of the top. The sealing cover is operable to expose the access opening and reclosable against the top to seal the access opening. The sealing cover, adhesive and top surface are optimized to provide sealing characteristics of sufficient resealing frequency, sufficiently low noise level during unsealing and desirable peel force to separate the seal between the sealing cover and the top.

In alternate further embodiments, the container has a sufficient resealing frequency of at least 25 times, a sufficiently low noise level during opening, a peel force between the sealing cover and the top in the range of 200 to 750 grams per inch and an adhesive which is FDA approved for direct contact with food.

In accordance with another aspect of the present invention, a polygonal food container comprises a frame defining the polygonal shape of the container and containing a food product. A wrapper surrounds the frame and forms a top of the container. The top has a cut-out flap portion defining an access opening sufficiently large to provide access to the food product. A resealable cover comprises a label adhesively joined to the flap portion of the top. The label has a larger surface area than a surface area of the flap thereby forming a sealing surface perimeter around the flap. The sealing surface forms a resealable seal with the top in a sealing area between the access opening and an adjacent edge of the top. The resealable cover is operable to expose the access opening and reclosable against the top to seal the access opening when the resealable cover is moved back against the top. The resealable cover is optimized to provide sealing characteristics of sufficient resealing frequency, sufficiently low noise during unsealing and desirable peel force to separate the seal between the resealable cover and the top.

These and other objects of the present invention will become apparent from the detailed description which follows, together with the accompanying drawings.

BRIEF DESCRIPTION OF THE DRAWINGS

There follows a detailed description of the preferred embodiments of the present invention, to be read together with the accompanying drawings, wherein.

DETAILED DESCRIPTION OF THE PREFERRED EMBODIMENTS

Figure 1:
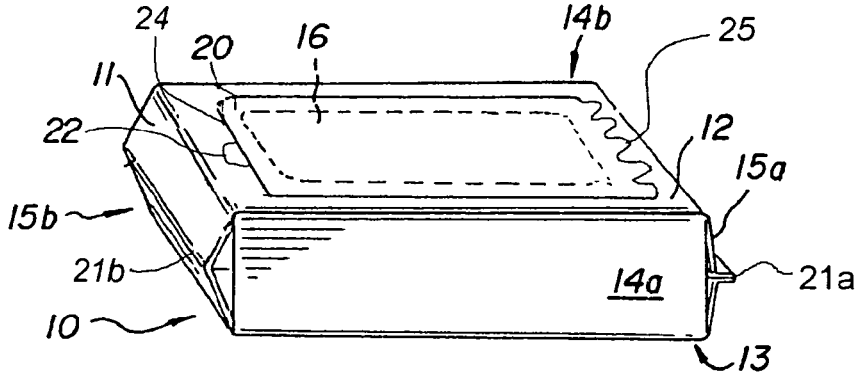
FIG. 1 is a perspective view of a resealable container in a closed configuration in accordance with the present invention.

Referring to the drawings, like elements are represented by like throughout the several views.

Figure 2:
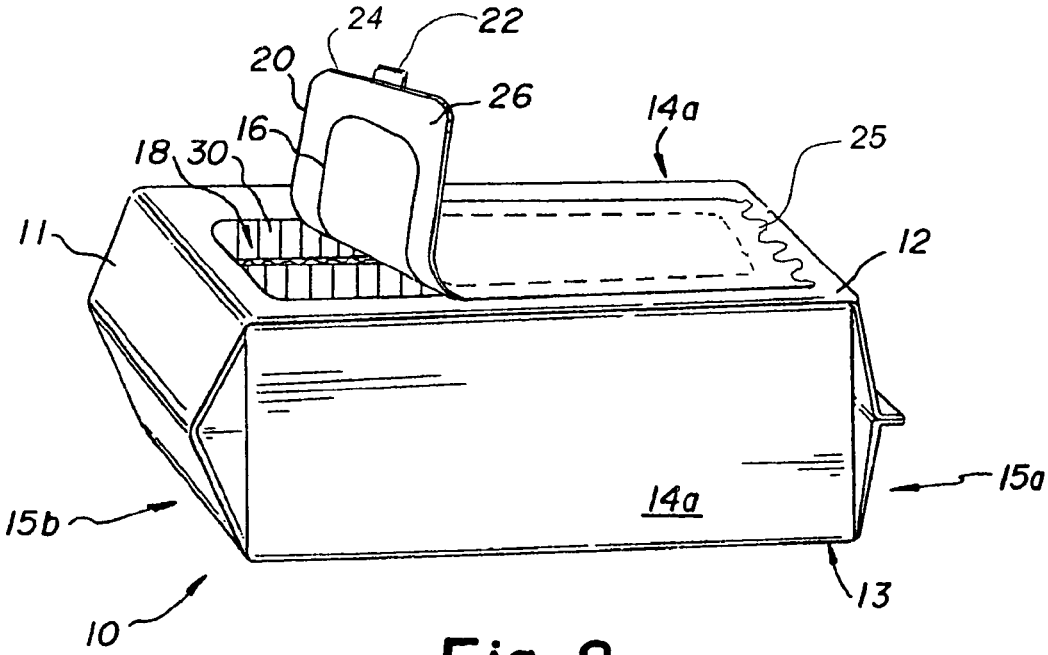
FIG. 2 is a perspective view of the container of FIG. 1 in a partially open configuration.

Referring specifically to FIGS. 1 and 2, resealable container 10 includes a wrapper 11 which forms top 12, bottom 13, opposing sides 14*a* and 14*b*, and opposing ends 15*a* and 15*b*. The top 12 has a cut-out forming flap 16. The flap 16, when pulled back from the container 10, forms an opening 18. The wrapper 11 extends past the end of top 12 and bottom 13 at ends 15*a* and 15*b*, where the wrapper 11 is crimped together to form crimp seals 21*a*, 21*b*.

A sealing cover is formed from sealing label 20 which is affixed to the flap 16. Advantageously, the sealing label 20 is permanently affixed to the flap 16 using an appropriate adhesive. The sealing label 20 covers a substantial portion of the top 12 extending from the proximity of end 15*b* to dovetail end 25 in the proximity of end 15*a* and from side 14*a* to side 14*b*.

The surface area of sealing label 20 is advantageously proportional to the size of opening 18. For example, if the sealing label 20 is too large, the covering could get caught or overlap corners of the package 10, or it could get caught up in the crimp seals 21*a*, 21*b*, both potentially hindering functionality of sealing label 20. Advantageously, the surface area of the sealing label 20 should be approximately 1.5 to 2 times and more preferably around 1.8 times the size of opening 18. Further, it is advantageous to have the size of opening 18 be proportional to the size of the package 10 and the food items contained therein so that, when the container is still full of food product, the consumer will have easy access to at least 90 percent of the food product inside the package, for example, not requiring one to reach deep inside the container 10 under top 12 in order to gain access to a food item contained therein. Of course as the container is emptied, the consumer can gain easy access to the remaining food product.

Graphics may be formed on the sealing label 20 which align with corresponding graphics on top 12 when the sealing label 20 is sealed or in a flap position on top 12. Alternatively, sealing label 20 may be transparent, allowing graphics of top 12 and flap 16 to be visible through the sealing label 20.

A starter portion, for example a tab 22 extends from sealing cover end 24 opposite the dovetail end 25. As a result, tab 22 can be grasped by one's fingers and thumb such that the tab 22 is easily accessible for one to pull. Further, the tab allows a user to reclose the package. The size of tab 22 and its shape are optimized for functionality. Advantageously, the tab 22 has a surface area of 1 to 6 percent that of the total surface area of sealing label 20.

Adhesive 26 is applied to the surface of sealing label 20 which is in contact with top 12 which includes a perimeter around flap 16. Advantageously, adhesive 26 provides a removable seal between the sealing label 20 and top 12. Adhesive 26 is not applied to tab portion 22.

The absence of an adhesive on tab 22 allows a consumer to more easily grasp the starter portion in order to open the container 10 since tab 22 will not be sealed to the top 12. In addition, by giving a consumer a specific portion of the sealing cover on which to pull, the consumer is not drawn to touching the adhesive portion of the sealing label 20 which, because of such touching, could lose its adhesiveness and thus not provide for a proper reseal against the top 12 of the container 10. This could, in turn, allow air to gain access to the interior of the container 10 and the food product contained therein.

The adhesive 26 has been optimized in order to function with the materials of top 12, flap 16, and sealing label 20. The amount of adhesive on the sealing label 20 affects the functionality and peel force required to separate the sealing label 20 from top 12. In order to achieve the purpose of the present invention, a balance is made among the adhesive force required to insure that the container remains closed, the ability of the container to have a sufficient number of resealing events, i.e., a resealing frequency, and a desirable peel force to separate the seal between the sealing cover 20 and top 12 which is light enough so that the package 10 can be opened easily.

One preferred adhesive is manufactured by Fasson identified by material safety data sheet (MSDS) Spec. Code 77711, Product No. R 5510. One preferred adhesive coat weight which provides desirable peel force and resealing frequency is an adhesive coat weight of 3 pounds per ream of material which comprises sealing label 20. The R 5510 adhesive applied with the aforementioned coat weight provides for a resealing frequency, i.e., opening and resealing of the container 10, of at least 25 times.

The adhesive 26 also provides for a desired peel force which is light enough to allow a consumer to easily peel back sealing label 20 while strong enough that a consumer is confident about the functionality of the container 10. Advantageously, the peel force between the sealing label 20 and top 12 should be in the range of 200 to 750 grams per inch when measured on a 1 inch strip using the ASTM standard for measuring peel strength. The ASTM standard tests the force necessary to peel a 1 inch strip of adhesive material, e.g., a label, from a substrate to which the label is applied. In the present case, preferably 200 to 750 grams per inch of force is necessary to peel a 1 inch strip of the material of sealing label 20 away from the material of top 12 to which the 1 inch strip is affixed. Further, it is desirable for the adhesive 26 to be relatively quiet upon separating the label 20 from the top 12.

The R 5510 adhesive 26 is FDA approved for contact with food. Further, the R 5510 adhesive does not present an undesirable or offensive odor for consumers or impart any odors to the food product contained inside the container 10.

The sealing label 20 is made of a suitable material which provides for a desired moisture vapor transmission rate (MVTR). The MVTR of sealing label 20 limits the amount of moisture transmission between the interior of container 10 and the outside environment, thus maintaining the freshness of the food product contained therein. One preferable material for the sealing label 20 is 2 mil biaxially oriented polypropylene (BOPP) material with a 0.15 $g/in^2/day$ MVTR. Preferable materials for the combination of the sealing label 20 and flap 16 have a maximum MVTR of 0.01 $g/in^2/day$.

A desirable low noise level during unsealing, i.e., separating sealing label 20 from top 12 is provided by using a combination of adhesive, adhesive coat weight, material of top 12, and the material of sealing label 20. It is the interaction between the aforementioned materials which accounts for the noise level. When the sealing label is the 2 mil BOPP and the adhesive 26 is R 5510 applied at an adhesive coat weight of 3 pounds per ream, polyethylene terephthalate material is a suitable material for forming the top layer 12 so as to form a container with desirable low noise level during unsealing.

Container 10 is transformed from a closed configuration depicted in FIG. 1 to a partially opened configuration depicted in FIG. 2 by grasping the tab 22 between ones fingers and thumb and pulling back on the sealing layer 20 to gain access to opening 18. Once container 10 is opened, one can remove individual food product contained inside the container 10 through opening 18.

Figure 3:
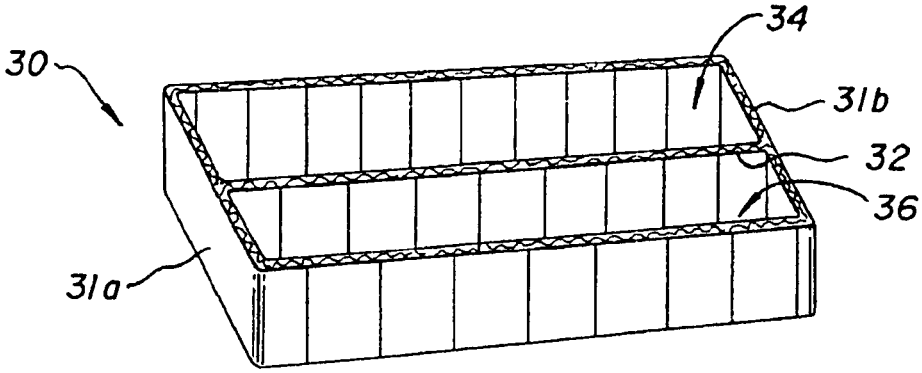
FIG. 3 is a perspective view of a frame of the container of FIGS. 1 and 2.

Wrapper 11 surrounds a frame 30 which forms a tray for receiving the food contents. Referring to FIG. 3, the frame 30 is composed of a rigid material which forms the shape of the container 10. Suitable rigid materials include plastics and cardboard. Frame 30 includes ends 31*a* and 31*b* a divider 32 which divides the frame 30 into a first section 34 and a second section 36.

Frame 30 can be any polygonal shape such as the rectangular shape depicted in FIG. 3. Accordingly, the rectangularly shaped frame 30 forms a rectangularly shaped container 10. Alternately, different polygonal shaped frames will form containers having the corresponding polygonal shape.

Figure 4:
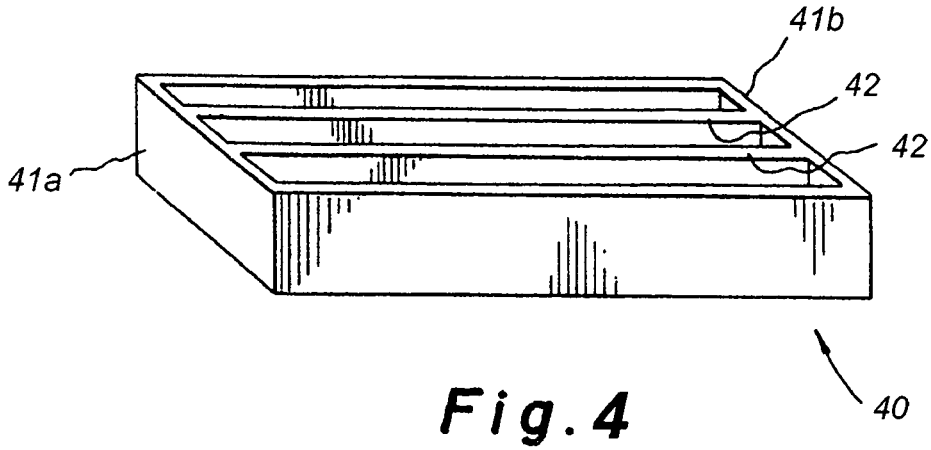
FIG. 4 is a perspective view of another frame of a resealable food container.
Figure 5:
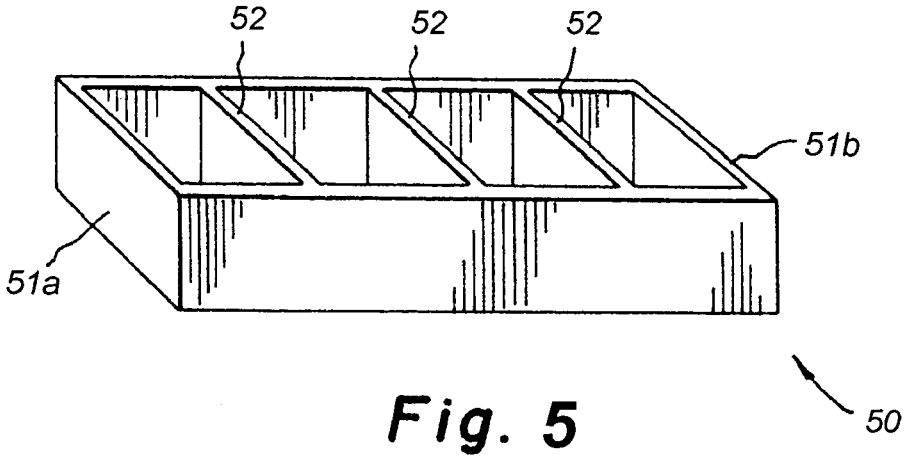
FIG. 5 is a perspective view of another frame of a resealable food container.
Figure 6:
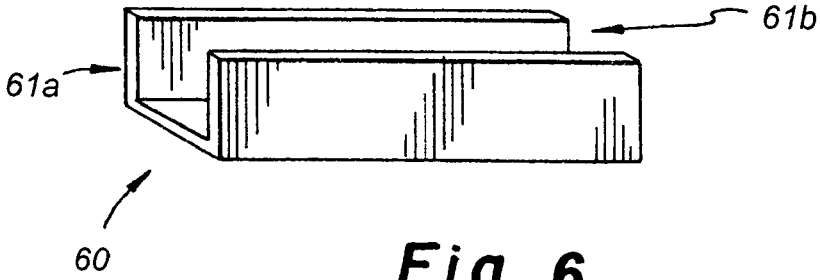
FIG. 6 is a perspective view of another frame for a resealable food container.

In other alternative embodiments, frames other than frame 30, which has a single divider 32 extending longitudinally along the length of the frame 30, can be used to form resealable containers. For example, referring to FIG. 4, frame 40 includes a plurality of dividers 42 extending longitudinally along the frame 40. Referring to FIG. 5, frame 50 includes a plurality of dividers 52 which extend transversely across the width of the frame 50. FIG. 6 depicts a frame 60 which does not include a divider. Selection of a particular frame depends on a desired use. Further, various frames may include ends such as frames 30, 40, and 50 which have ends 31*a*, 31*b*, 41*a*, 41*b*, 51*a*, 51*b*; or the frame may be opened at the ends such as frame 60 with open ends 61*a*, 61*b*.

Figure 7:
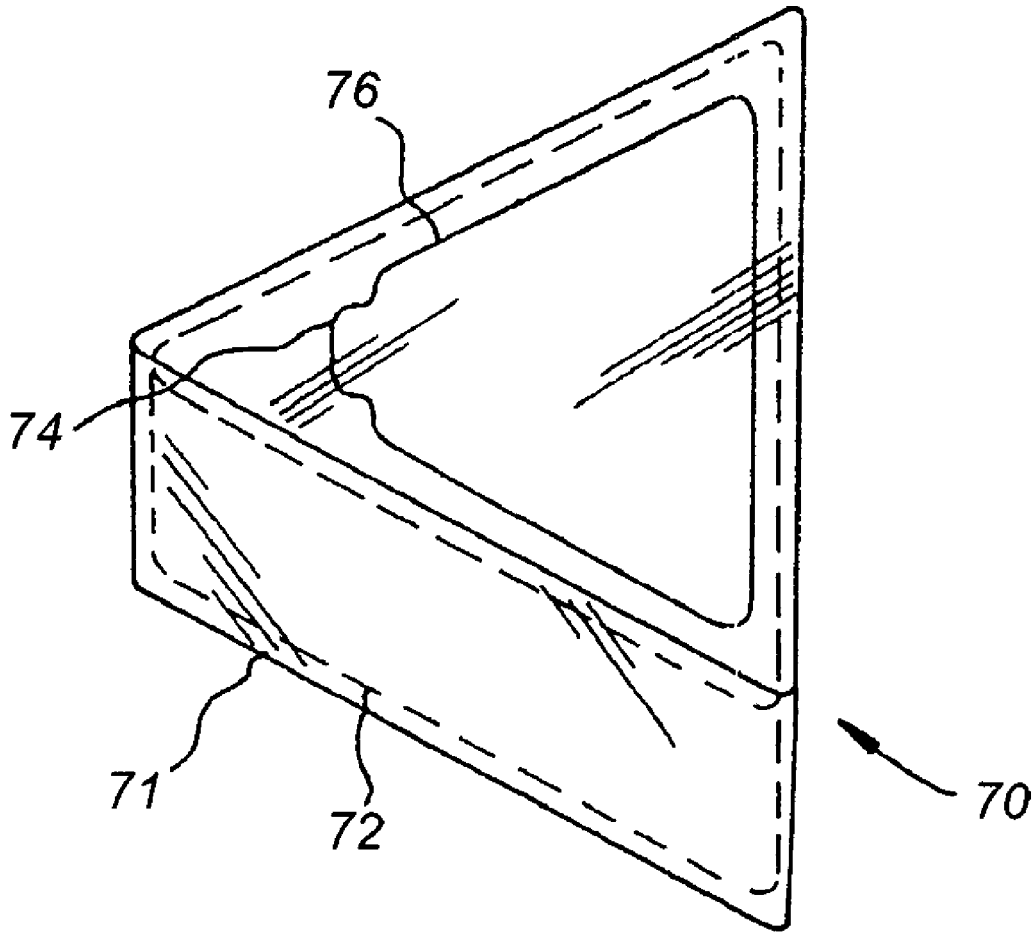
FIG. 7 is a perspective view of a polygonal shaped resealable food container in accordance with another embodiment of the present invention.
Figure 8:
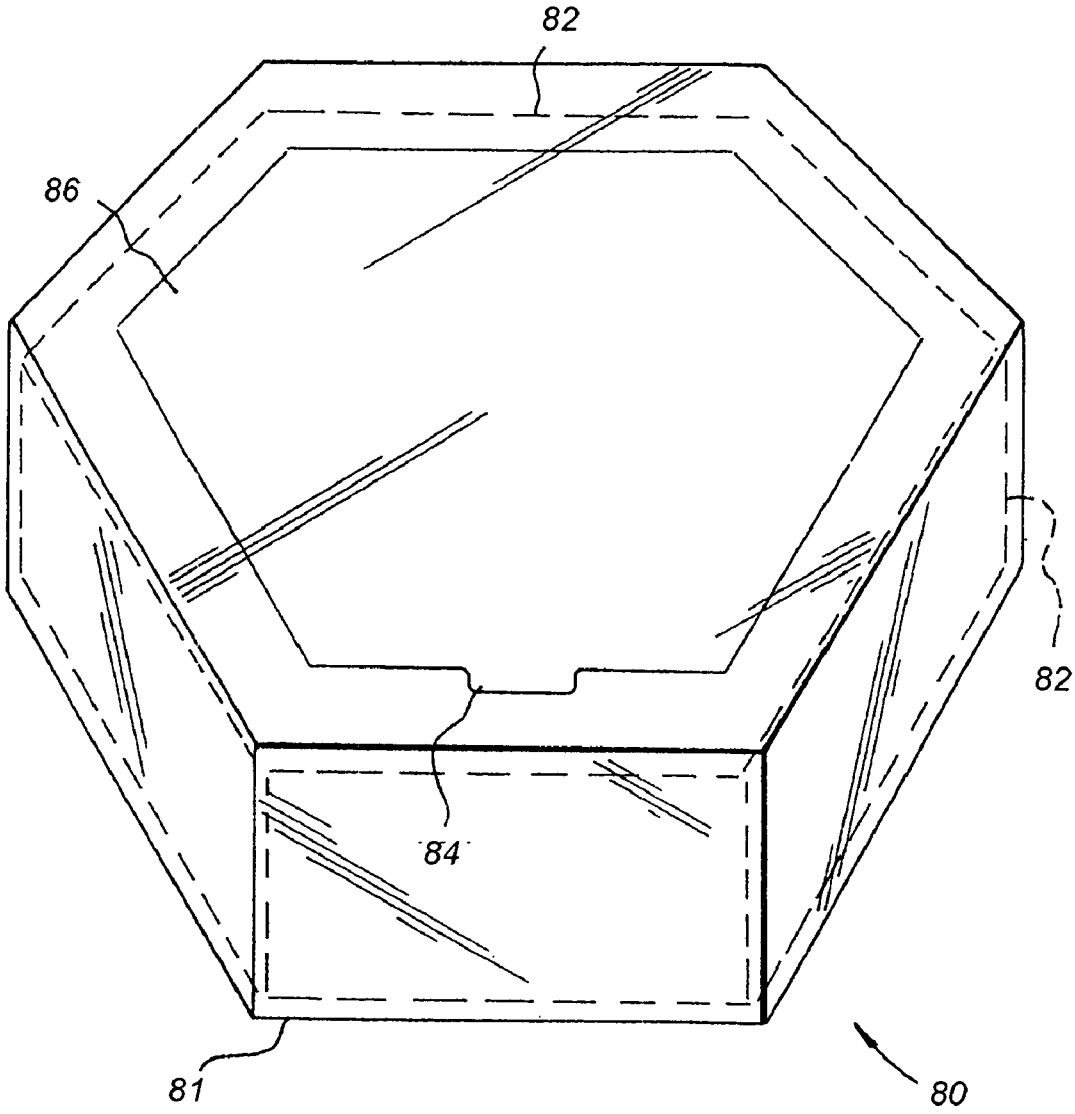
FIG. 8 is a perspective view of a different polygonal shaped resealable food container.

In an alternative embodiment, rather than a rectangular container, the container may be in the form of any polygonal shape although rectangular, which includes square, is the preferred polygonal shape. As previously discussed, the polygonal shape of the container takes its form from the frame which is covered by a wrapper. For example, referring to FIG. 7, container 70 is a triangular shaped polygonal container formed by wrapper 71 surrounding frame 72. In an alternative polygonal shape, FIG. 8 depicts container 80 in the shape of a hexagon defined by wrapper 81 which surrounds frame 82. As in the embodiment of FIGS. 1 and 2, one gains access to the contents of containers 70, 80 by pulling back on tabs 74, 84 of sealing cover 76, 86, respectively.

The present invention offers numerous features and advantages over previous food containers. For example, the present container includes a sealing cover which is adhesively sealed to a top surface in which the sealing cover, adhesive and top surface material are optimized to provide sealing characteristics of sufficient resealing frequency, sufficiently low noise level during unsealing, and desirable peel force to separate the seal between the sealing cover and the top.

Although the invention has been described in detail with respect to the preferred embodiments thereof, it will be apparent to one of ordinary skill in the art that the invention is capable of numerous variations and modifications within the scope and spirit of the invention.

We claim:

1. A polygonal food container comprising, a frame defining the polygonal shape of the container and containing a food product;

a wrapper surrounding the frame, said wrapper forming a top of the container;

the top having an access opening sufficiently large enough to provide access to the food product; and a sealing cover having an adhesive and forming a resealable seal to the top in a sealing area between the access opening and an adjacent edge of the top, said sealing cover being operable to expose the access opening and reclosable against the top to seal the access opening, wherein said sealing cover, adhesive and top surface are optimized to provide sealing characteristics of sufficient resealing frequency and desirable peel force to separate the seal between said sealing cover and said top.

2. The container of claim 1, wherein said sufficient resealing frequency is at least twenty-five.

3. The container of claim 1, wherein said sufficiently low noise level is provided by said adhesive being relatively quiet upon opening said container.

4. The container of claim 1, wherein said peel force between said sealing cover and said top is in the range of 200 to 750 grams per inch when measured on a one inch strip of said sealing cover with said adhesive using the ASTM standard for peel strength.

5. The container according to claim 1, wherein the polygonal package is generally rectangular.

6. The container according to claim 1, wherein the access opening is sufficiently large to provide hand access to substantially all of the food product contained within the frame.

7. The container according to claim 1, wherein the sealing cover includes a starter portion.

8. The container of claim 7, wherein said starter portion is not adhesively sealed to the top and is shaped and positioned to be grasped by a user.

9. The container of claim 8, wherein said starter portion has a surface area in the range of 1 to 6 percent of the total surface area of the sealing cover.

10. The container of claim 1, wherein said sealing cover comprises a label adhesively joined to a flap portion of said top, said label having a larger surface area than said flap portion.

11. The container of claim 10, wherein said label comprises a biaxially oriented polypropylene material.

12. The container of claim 10, wherein said label has a surface area greater than said access opening in said top.

13. The container of claim 10, wherein said surface area of said label is between 1.5 and 2.0 times the area of said opening in said top.

14. The container of claim 10, wherein said label comprises 2 mil biaxially oriented polypropylene with a 0.15 $g/in^2/day$ moisture vapor transmission rate.

15. The container of claim 10, wherein said flap portion is substantially the same size as said opening in said top.

16. The container of claim 1, wherein said adhesive is FDA approved for direct contact with food.

17. The container of claim 1, wherein said adhesive does not impart a human perceivable undesirable odor.

18. The container of claim 1, wherein, when the container is full of food product said opening provides direct access to at least 90 percent of the food product contained therein.

19. The container of claim 1, wherein said adhesive is applied to said sealing cover along a sealing surface in an amount of about three pounds per ream of stock sealing cover material.

20. The container of claim 1, wherein said top comprises polyethylene terephthalate.

21. The container of claim 1 wherein said frame is rectangular shaped, defining a rectangular shaped container.

22. The container of claim 1, wherein said sling cover is transparent.

23. A polygonal food container comprising, a frame defining the polygonal shape of the container and containing a food product;

a wrapper surrounding the frame, said wrapper forming a top of the container;

said top having a cut-out flap portion defining an access opening sufficiently large to provide access to the food product; and a resealable cover comprising a label adhesively joined to said flap portion of said top, said label having a larger surface area than a surface area of said flap portion, thereby forming a sealing surface perimeter around said flap portion, said label having a surface area greater than said access opening in said top, said sealing surface forming a resealable seal with the top in a sealing area between the access opening and an adjacent edge of the top, said resealable cover being operable to expose the access opening and reclosable against the top to seal the access opening when said resealable cover is moved back against the said top, wherein said resealable cover is optimized to provide sealing characteristics of sufficient resealing frequency and desirable peel force to separate the seal between said resealable cover and said top.

24. The container of claim 23, wherein said sufficient resealing frequency is at least twenty-five.

25. The container of claim 23, wherein said adhesive is relatively quiet upon opening said container.

26. The container of claim 23, wherein said peel force between said resealable cover and said top is in the range of 200 to 750 grams per inch when measured on a one inch strip of said resealable cover with said adhesive using the ASTM standard for peel strength.

27. The container according to claim 23, wherein the polygonal package is generally rectangular.

28. The container according to claim 23, wherein the access opening is sufficiently large to provide hand access to substantially all of the food product contained within the frame.

29. The container according to claim 23, wherein the resealable cover includes a starter portion.

30. The container of claim 29, wherein said starter portion is not adhesively sealed to the top and is shaped and positioned to be grasped by a user.

31. The container of claim 29, wherein said starter portion has a surface area which is in the range of 1 to 6 percent of the total surface area of the resealable cover.

32. The container of claim 23, wherein said label comprises biaxially oriented polypropylene.

33. The container of claim 23, wherein said label has a surface area greater than said access opening in said top.

34. The container of claim 23, wherein said surface area of said label is between 1.5 and 2.0 times the area of said opening in said top.

35. The container of claim 23, wherein said label comprises 2 mil biaxially oriented polypropylene with a 0.15 $g/in^2/day$ moisture vapor transmission rate.

36. The container of claim 23, wherein said adhesive is FDA approved for direct contact with food.

37. The container of claim 23, wherein said adhesive does not impart a human perceivable undesirable odor.

38. The container of claim 23, wherein, when the container is full of food product, said opening provides direct access to at least 90 percent of the food product contained therein.

39. The container of claim 23, wherein said adhesive is applied to said resealable cover in an amount of about three pounds per ream of stock cover material.

40. The container of claim 23, wherein said top comprises polyethylene terephthalate.

41. The container of claim 23, wherein said frame is rectangular shaped, defining a rectangular shaped container.

42. The container of claim 23, wherein said sealing cover is transparent.

43. A shaped food product container in combination with a food product contained therein, an overall structure of the container imparting a certain shape to the container, which shape is defined by a structure other than one of the size and the shape of the food product within the container, the container further including a wrapper forming at least a portion of the exterior of the container and conforming to the imparted certain shape, the imparted certain shape causing the wrapper to have at least one outer surface access area which has an access opening so as to provide access to the food product within the container, and a sealing cover adhesively sealed to said outer surface access area so as to cover said access opening, said sealing cover being resealable and reclosable against said outer surface access area to seal said access opening when said sealing cover, after having been initially opened, is moved back against said outer surface access area, wherein said sealing cover, adhesive and outer surface are optimized to provide sealing characteristics of sufficient resealing frequency and desirable peel force to separate the seal between said sealing cover and said outer surface.

44. The container in combination with a food product of claim 43, wherein the container has a top, a bottom, and sides conforming to the certain shape, and wherein the top forms the outer surface access area.

45. The container in combination with a food product of claim 43, wherein the wrapper is a flexible material.

46. The container in combination with a food product of claim 43, wherein the structure imparting the shape to the container comprises at least one tray within the wrapper, the food product located in the at least one tray.

47. The container in combination with a food product of claim 43, wherein the wrapper forms substantially the entire exterior of the container.

48. The container in combination with a food product of claim 47, wherein the wrapper is a flexible material.

49. The container in combination with a food product of claim 43, wherein the access opening is large enough to provide hand access to the food product within the container.

50. The container in combination with a food product invention of claim 43, wherein the outer surface access area is generally flat.

51. A food container in combination with a food product located within the container, the food product being discrete food articles, a wrapper forming the exterior of the container and having an outer surface access area, an overall structure of the container imparting to the wrapper a certain shape, which certain shape is independent of one of the size and the shape of the discrete food articles within the container, an access opening formed in the outer surface access area so as to provide access to the discrete food articles within the container, and a sealing cover adhesively sealed to the outer surface access area so as to cover the access opening, said sealing layer being releasable and reclosable against the outer surface access area around the access opening to seal the access opening after the sealing cover, having been initially opened, is moved back against the outer surface access area, wherein said sealing cover, adhesive and outer surface are optimized to provide sealing characteristics of sufficient resealing frequency and desirable peel force to separate the seal between said sealing cover and said outer surface.

52. The container in combination with a food product invention of claim 51, wherein the wrapper is a flexible material.

53. The container in combination with a food product invention of claim 51, wherein the structure imparting the certain shape to the container comprises at least one tray within the wrapper, the food product located in the at least one tray.

54. The container in combination with a food product invention of claim 51, wherein the access opening is large enough to provide hand access to the food product within the container.

55. The container in combination with a food product invention of claim 51, wherein the sealing cover includes a starter portion located at one side of the outer surface access area for grasping and pulling back the sealing cover to increase a size of an exposure of the access opening.

56. The container in combination with a food product invention of claim 55, wherein the sealing cover is shaped to releasably seal to a portion of the outer surface access area after it, having been pulled back, is returned to a position covering the access opening.

* * * * *

UNITED STATES PATENT AND TRADEMARK OFFICE

CERTIFICATE OF CORRECTION

PATENT NO. : 7,350,688 B2
APPLICATION NO. : 11/029626
DATED : April 1, 2008
INVENTOR(S) : Sierra-Gomez et al.

It is certified that error appears in the above-identified patent and that said Letters Patent is hereby corrected as shown below:

On the Title page Item (75) Inventors:
Change "Alexis Julian Garcia-Lugo" to
--Alexis Julian Gracia-Lugo--.

In column 7, line 7, please change "claim 1 wherein" to -- claim 1, wherein --.

In column 7, line 9, please change "sling" to -- sealing --.

Signed and Sealed this

Twenty-sixth Day of August, 2008

JON W. DUDAS
*Director of the United States Patent and Trademark Office*